US005330885A

United States Patent [19]

Takamuki et al.

[11] Patent Number: 5,330,885

[45] Date of Patent: Jul. 19, 1994

[54] SILVER HALIDE PHOTOGRAPHIC LIGHT-SENSITIVE MATERIAL

[75] Inventors: Yasuhiko Takamuki; Kazuhiro Yoshida; Takeo Arai, all of Hino, Japan

[73] Assignee: Konica Corporation, Tokyo, Japan

[21] Appl. No.: 13,300

[22] Filed: Feb. 4, 1993

[30] Foreign Application Priority Data

Feb. 17, 1992 [JP] Japan ..... 4-029622

[51] Int. Cl.[5] ..... G03C 1/76

[52] U.S. Cl. ..... 430/523; 430/525; 430/537; 430/627; 430/628; 430/631; 430/961

[58] Field of Search ..... 430/642, 627, 628, 531, 430/537, 639, 961, 523, 631, 525

[56] References Cited

U.S. PATENT DOCUMENTS 2,794,787 6/1957 Coover, Jr. .
2,831,767 4/1958 Dann et al. ..... 96/114
2,956,884 10/1960 Caldwell ..... 96/114
5,066,572 11/1991 O'Connor et al. ..... 430/503
5,075,209 12/1991 Sasaki ..... 430/587

FOREIGN PATENT DOCUMENTS 383283 8/1990 European Pat. Off. .

*Primary Examiner*—Thorl Chea
*Attorney, Agent, or Firm*—Jordan B. Bierman

[57] ABSTRACT

A silver halide photographic light-sensitive material comprising a support having thereon at least one light-sensitive silver halide emulsion layer, wherein at least one hydrophilic colloidal layer containing said light-sensitive silver halide emulsion layer comprises the polymer latex stabilized by gelatin, and the outermost layer on the side containing said light-sensitive silver halide emulsion layer and/or the outermost layer on the other side comprises the anionic fluorine containing surfactant and/or cationic fluorine containing surfactant.

7 Claims, No Drawings

SILVER HALIDE PHOTOGRAPHIC LIGHT-SENSITIVE MATERIAL

BACKGROUND OF THE INVENTION

The present invention relates to a silver halide photographic light-sensitive material, and specifically, a silver halide photographic light-sensitive material with excellent dimensional stability, free from stickiness and deterioration of sensitivity after storage.

Gelatin has high swellability and gelation performance and is crosslinked easily by various hardeners. It is generally used as a binder for silver halide photographic light-sensitive material. Gelatin is an excellent binder to coat, by adjusting the physical properties of a coating solution, uniformly a wide area of such materials unsuitable to high temperature as light-sensitive silver halide.

The silver halide grains change into extremely hard metallic silver when the gelatin layer absorbs water and swells sufficiently during development of the silver halide photographic light-sensitive material. As a result, the emulsion layer does not recover after drying and the size of the light-sensitive material before and after processing is different.

Therefore, there is a known technique of improving the physical properties of light-sensitive materials by including polymer latex in the silver halide emulsion layer and backing layer.

Such a technique is described, for instance, in Research Disclosure No. 19951, Japanese Patent Examined Publication Nos. 39-4272, 39-17702 and 43-13482, U.S. Pat. Nos. 2376005, 2763625, 2772166, 2852386, 2853457 and 3397988. Additionally, Japanese Patent L.O.P. Nos. 59-38741, 61-296348, 61-284756 and 61-285446 disclose the method of making fine oil particles of paraffin and vinyl polymer contained in. However, conventional technic is not sufficient and needs improvement. When a large amount is added in the gelatin, the latex flocculates and any further additional amount shows no effect. It is especially required to improve the variation of dimensional difference before and after processing, depending on environmental humidity.

Moreover, a large amount of latex added in the gelatin causes sticking and deterioration of sensitivity after long preservation. While Japanese Patent Examined Publication No. 58-9408 discloses the method of adding a fluorine type surfactant to improve such stickiness, a comprehensive solution, including improvement of dimensional stability, is demanded.

SUMMARY OF THE INVENTION

The object of the present invention is to provide a silver halide photographic light-sensitive material with excellent dimensional stability, free from stickiness and deterioration of sensitivity by storage.

The silver halide photographic light-sensitive material of the present invention comprises a support and at least one light-sensitive silver halide emulsion layer thereon; and at least one hydrophilic colloidal layer, including said light-sensitive silver halide emulsion layer, comprises a polymer latex stabilized by gelatin, and at least one of the outermost layers on each side contains an anionic fluorine containing surfactant represented by the following Formula FA and/or a cationic fluorine containing surfactant represented by Formula FK.

Formula FA $$Rf—A_nY$$

wherein, Rf represents a fluorine substituted alkyl group or an aryl group having 3 to 30 carbon atoms, A represents a divalent group having 1 to 12 carbon atoms containing at least one bond of $$—O—,\ —COO—,\ —\underset{\underset{R_1}{|}}{CON}—\ \text{or}\ —\underset{\underset{R_1}{|}}{SO_2N}—,$$

wherein $R_1$ represents an alkyl group having 1 to 5 carbon atoms, n is 1 or 2, and Y represents $$—COOM,\ —SO_3M—,\ —OSO_3M\ \text{or}\ —\underset{\underset{O}{\|}}{P}(OM)_2,$$

wherein M represents a hydrogen atom or cations such as alkali metal, alkaline earth metal and quaternary ammonium salts.

Formula FK $$(Df—W)_n$$

wherein, Df represents the n-valent group which contains at least three fluorine atoms and at least three carbon atoms, W represents $$—N^+\begin{matrix} R_1 \\ R_2 \\ R_3 \end{matrix}\ X^-\ \text{or}\ —^+N\qquad Z\ X^-$$

wherein R1, R2, and R3 each represent an alkyl group having 1 to 4 carbon atoms such as a methyl group, ethyl group and butyl group, or an alkyl group substituted by a univalent group such as a hydroxymethyl group and Y-hydroxypropyl group, X represents a halogen atom such as chlorine, bromine and iodine, or the $R\text{-}SO_2—O^-$group (R is an alkyl group or an aryl group having 1 to 10 carbon atoms), Z represents an atomic group necessary to constitute a 5 or 6-membered cycles, such as a pyrrole cycle, imidazoline cycle, oxazole cycle, pyridine cycle and pyrimidine .cycle with a nitrogen atom, and n is 1 or 2.

The total amount of gelatin in a hydrophilic colloidal layer coated on the support is preferably not more than 2.7 g/m$^2$ per each side.

The present invention is hereinafter explained in detail.

A characteristic of the polymer latex stabilized by gelatin in the present invention is that the surface and/or the inside of the polymer latex is dispersed and stabilized by gelatin. It is preferable that the polymer which constitutes the latex and gelatin have some kind of bond, and in this case, the polymer and the gelatin can bond directly or bond by a crosslinking agent.

The polymer latex stabilized by the gelatin of the present invention can be obtained by adding the gelatin solution to a reaction system to be reacted after the polymerization reaction of the polymer latex. It is preferable to react polymer latex synthesized in the surfactant with gelatin by using a crosslinking agent. The latex can also be obtained by the presence of gelatin during polymerization reaction of the polymer, and it is more preferable than the above-mentioned method. It is preferable not to use surfactant during the polymerization reaction of the polymer. When the surfactant is used, the addition amount is between 0.1 and 3.0%, and preferably between 0.1 and 1.5%, to the polymer element. The present inventors found that the ratio of the added amount of the gelatin and the latex has a specific criticality during research for improvement of the physical properties of the light-sensitive material.

The ratio of the gelatin and the polymer during synthesis is preferably .between 1:100 and 2: 1, and more preferably between 1:50 and 1:2 by weight.

The average particle size of the polymer latex stabilized by the gelatin of the present invention is preferably between 0.005 and 1 μm, and more preferably between 0.02 and 0.5 μm.

The polymer latex stabilized by the gelatin of the present invention includes hydrates of such vinyl polymers as acrylic acid ester, methacrylate acid ester and styrene, described, for instance, in U.S. Pat. Nos. 2,772,166, 3,325,286, 3,411,911, 3,311,912, 3,525,620, and Research Disclosure No. 195 19551. (July, 1980)

The polymer latex part of the polymer latex stabilized by gelatin preferably used for the present invention includes homopolymer of metaalkylacrylates, such as methylmethacrylate and ethylmethacrylate, or homopolymer of styrene, copolymer of metaalkylacrylate or styrene, and acrylic acid, N-methylolacrylamide or glycidolmethacrylate; homopolymer of alkylacrylates such as methylacrylate, ethylacrylate and butylacrylate, copolymer of alkylacrylate and acrylic acid or N-methylol-acrylamide (preferably, the copolymerization element of acrylic acids is up to 30% by weight); homopolymer of butadiene, copolymer of butadiene and at least one of styrene, buthoxy-methylacrylic amide or acrylic acid; and ternary copolymer of vinylidene chloride-methylacrylateacrylic acid.

When the gelatin is bonded using a crosslinking agent, it is preferable that the monomer which constitutes the polymer latex includes a carboxyl group, an amino group, an amide group, an epoxy group, a hydroxyl group, an aldehyde group, an oxazoline group, an ether group, an active ester group, a methylol group, a cyano group, an acetyl group and a reactive group such as unsaturated carbon bond. The crosslinking agent may be one usually used for gelatin such as an aldehyde type, a glycol type, a triazine type, an epoxy type, a vinyl sulfone type, an oxazoline type, a methacrylate type and an acrylic type. The 2-acrylic amide-2-methylpropane sulfonic acid or its salt may be used as a monomer which constitutes polymer latex to enhance the dispersion stability of the polymer latex stabilized by the gelatin of the present invention. The added amount of the above-mentioned monomer is preferably 0.5 to 20% by weight of the total weight in the constitutional element.

Further to the gelatin used to stabilize the latex of the present invention it is possible to use ,in combination, a hydrophilic colloid such as grafted polymer of gelatin, other protein than gelatin,-sugar derivative, cellulose derivative and synthetic hydrophilic high polymer material such as a homopolymer or copolymer.

The lime processed gelatin and the acid-processed gelatin described in page 30 of Bull. Soc. Sci. Phot. Japan No. 16 (1966) may be used, and the hydrolysis product and the enzyme degradation product of the gelatin may also be used. The gelatin derivative can be obtained by reacting the gelatin with various kinds of compounds such as acid halide, acid anhydride, isocyanates, bromo acetic acid, alkane sultones, vinylsulfon amides, maleinimide compounds, polyalkylene oxides and epoxy compounds. The specific examples are described in U.S. Pat. Nos. 2,614,928, 3,132,945, 3,186,846 and 3,312,553, British Patent Nos. 861,414, 1,033,189 and 1,005,784, and Japanese Patent Examined Publication No. 42-26845.

An albumin and a casein as the protein, a hydroxyethyl-cellulose, a carboxymethylcellulose and a sulfate of cellulose as the cellulose derivative, and an algin acid soda and a starch derivative as the sugar derivative may be used with the gelatin.

Though the polymer latex stabilized by the gelatin used for the present invention may be added to at least one hydrophilic colloidal layer, it is preferable to be added to both the light-sensitive hydrophilic colloidal layer and the non-light-sensitive hydrophilic colloidal layer on the side of a light-sensitive hydrophilic colloidal layer. It may be comprised either on one side of the support or both sides. It has been proven that the effect of dimensional stability is remarkably enhanced when the added amount of the latex of the invention is not less than 30%, and preferably between 30% and 200%, to the gelatin in each hydrophilic colloidal layer by weight. A conventional latex can be added to a layer to which the latex of the present invention is added and/or is not added. When on both sides of the support, the kind and/or the amount of the polymer latex of each side may either be the same or different.

Specific examples of the latex used for the present invention are shown as follows. The examples of the latex in this specification represent the latex of an arbitrary composition ratio of the latex of which the constitutional element consists.

Specific examples of latex

L-1

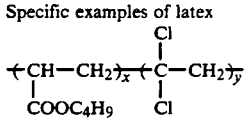

(x/y = 50/50)

L-2

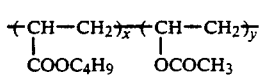

(x/y = 50/50)

L-3

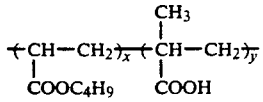

(x/y = 95.6/4.4)

-continued
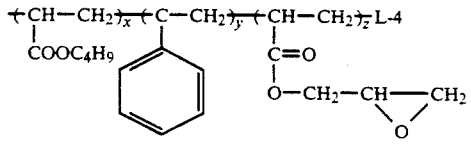
L-4
(x/y/z = 40/20/40)
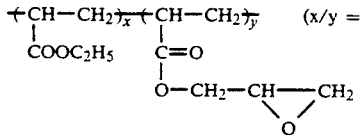
(x/y = 50/50)
L-5
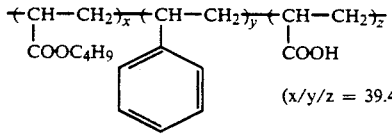
(x/y/z = 39.4/59/1.6)
L-6
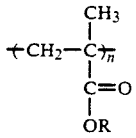
R: $-CH_3$, $C_2H_5$, $C_4H_9$
L-7
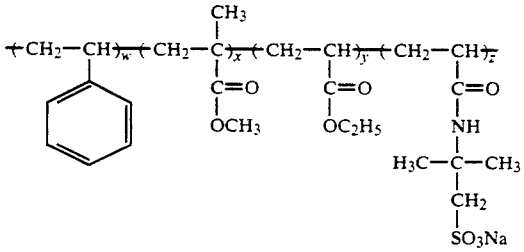
(w/x/y/z = 30/30/32/8)
L-8
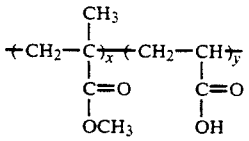
(x/y = 93/7)
L-9
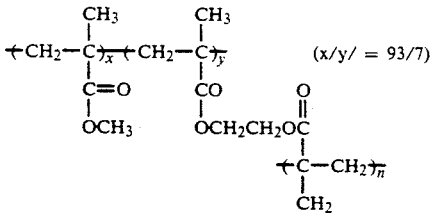
(x/y/ = 93/7)
L-10
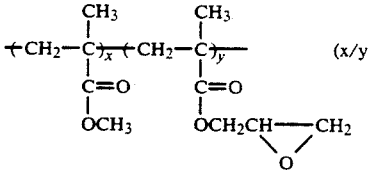
(x/y = 93/7)
L-11
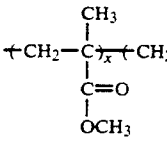
(x/y = 93/7)
L-12

-continued
L-13
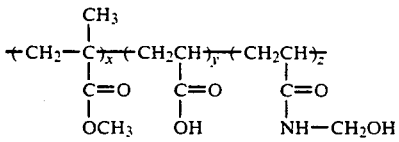
(x/y/z = 93/3/4)
L-14
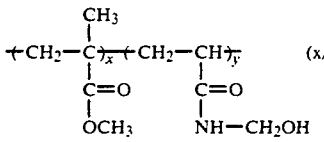
(x/y = 93/7)
L-15
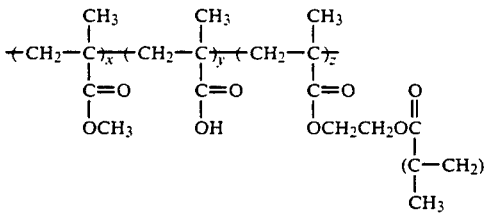
(x/y/z = 93/3/4)
L-16
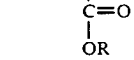
R: $-CH_3$, $-C_2H_5$, $-C_4H_9$
L-17
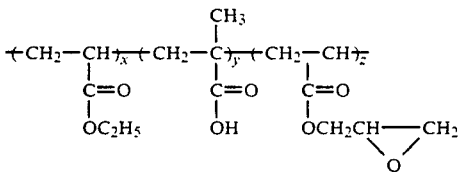
(x/y/z = 93/3/4)
L-18
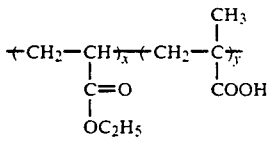
(x/y = 93/7)
L-19
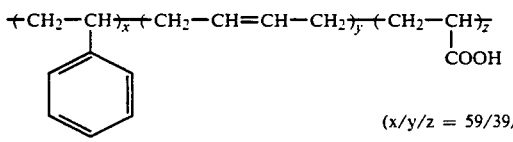
(x/y/z = 59/39/2)
L-20
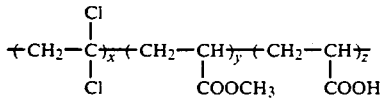
(x/y/z = 85/13/2)
L-21
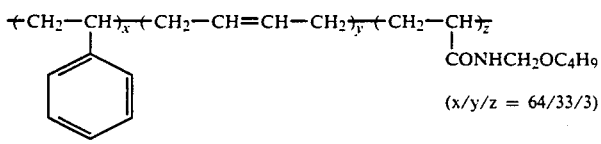
(x/y/z = 64/33/3)

-continued
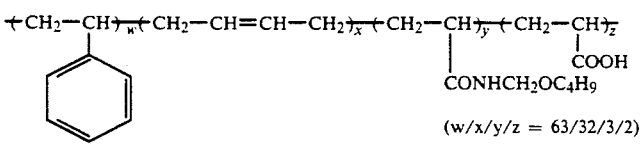
(w/x/y/z = 63/32/3/2) L-22
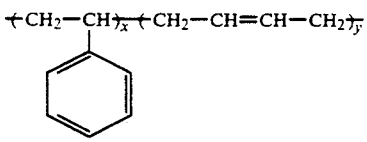
(x/y = 67/33) L-23
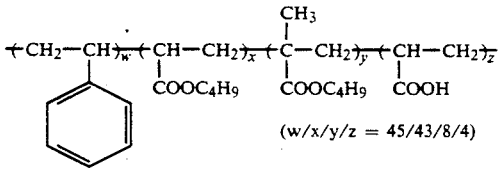
(w/x/y/z = 45/43/8/4) L-24
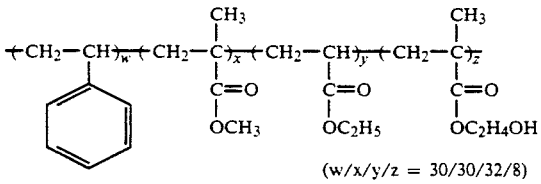
(w/x/y/z = 30/30/32/8) L-25
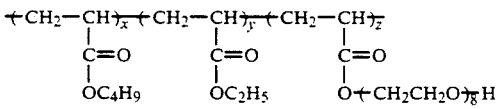
(x/y/z = 40/52/8) L-26
The specific examples of the anionic fluorine containing surfactant represented by Formula FA are shown as follows.
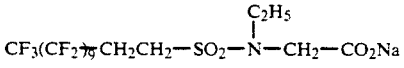
FA-1
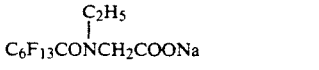
FA-2
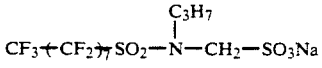
FA-3
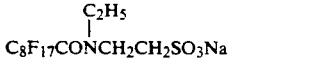
FA-4
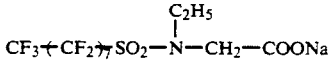
FA-5
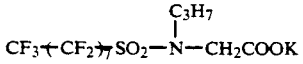
FA-6
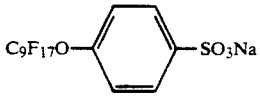
FA-7
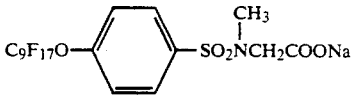
FA-8
-continued
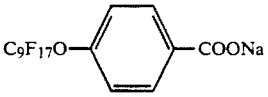
FA-9
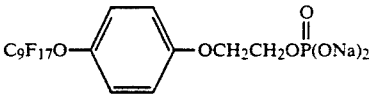
FA-10
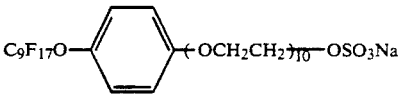
FA-11
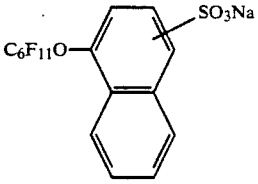
FA-12
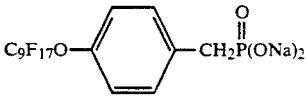
FA-13

-continued
FA-14
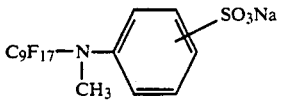
FA-15
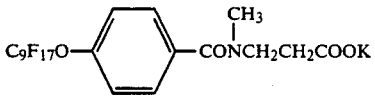
FA-16
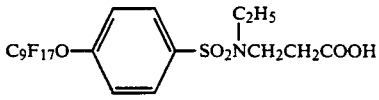
FA-17
$C_9F_{17}OCH_2CH_2SO_3Na$
FA-18
$C_9F_{17}OCH_2CH_2CH_2CH_2OP(=O)(ONa)_2$
-continued
FA-19
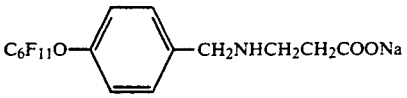
FA-20
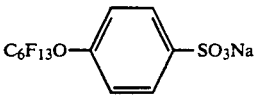
FA-21
$HCF_2(CF_2)_8OCH_2CH_2CH_2SO_3Na$
FA-22
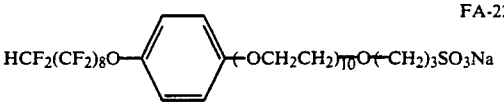
The specific examples of the cationic fluorine containing surfactant represented by Formula FK are shown as follows.
FK-1
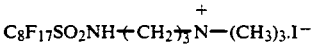
FK-2
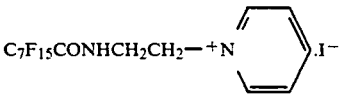
FK-3
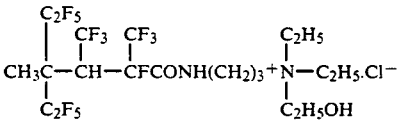
FK-4
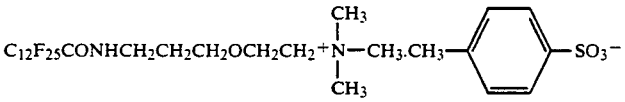
FK-4
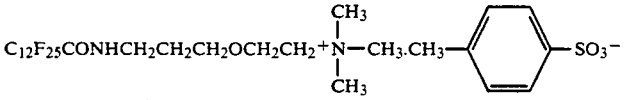
FK-5
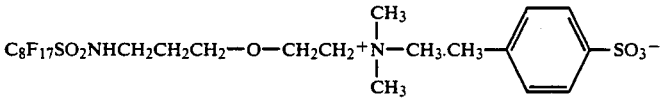
FK-6
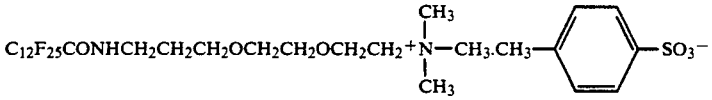
FK-7
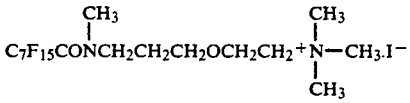
FK-8
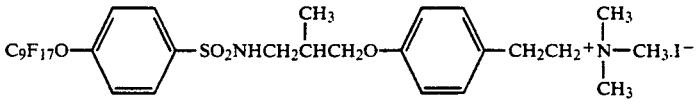

-continued

FK-9

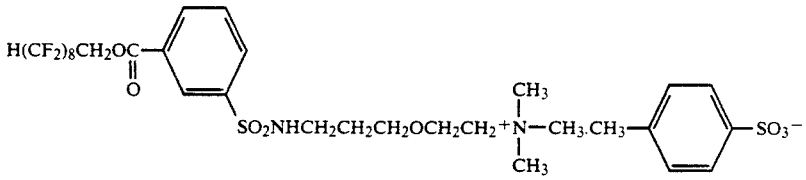

FK-10

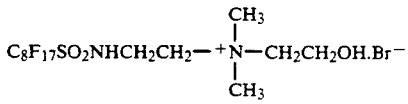

FK-11

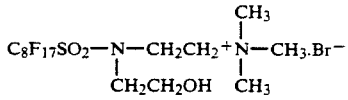

FK-12

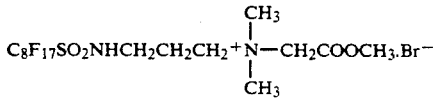

FK-13

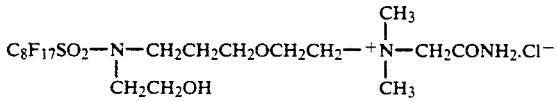

FK-14

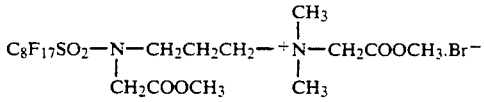

FK-15

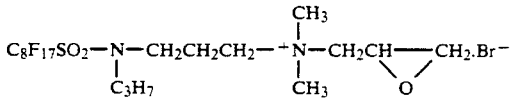

FK-16

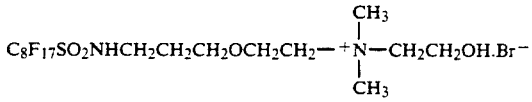

The fluorine type cationic surfactant or the fluorine type anionic surfactant related to the present invention may be synthesized by the method as described in U.S. Pat. Nos. 2,559,751, 2,567,011, 2,732,398, 2,764,602, 2,806,866, 2,809,998, 2,915,376, 2,915,528, 2,934,450, 2,937,098, 2,957,031, 3,472,894, 3,555,089 and 2,918,501, British Patent Nos. 1,143,927 and 1,130,822, Japanese Patent Examined Publication No. 45-37304 Japanese Patent L.O.P. Nos. 47-9613, 50-121243, 50-117705, 49-134614, 50-117727, 52-41182 and 51-12392, page 2789 of J. Chem. Soc. 1950, page 2574 and page 2640 of J. Chem. Soc. 1957, page 2549 of J. Amer. Chem. Soc. Vol. 79 (1957), page 653 of J. Japan. Oil Chemists Soc. Vol. 12, and page 3524 of J. Org. Chem. Vol. 30 (1965).

Some of these fluorine containing surfactants related to the present invention are marketed under the name of Megafac F by Dai Nippon Ink Chemical Co. Ltd., Fluorad FC by Minnesota Mining & Manufacturing Co. Ltd., Monflor by Imperial Chemical Industry Co. Ltd., Zonyls by E. I. du Pont de Nemours & Co. Inc., and Licowet VPF by Falbewerke Hecht Co. Ltd.

Each surfactant represented by above Formulae FA and FK may be added independently or in combination, for more preferable effect. Though they may be added to the outermost layer of the emulsion layer side or that of the other side of the support, they are more effectively added to the outermost layer of the side with the layer comprising the polymer latex stabilized by gelatin. The added amount of each side is preferably 0.5 to 50 mg/m$^2$. Not less than 100 mg/m$^2$ in total weight is preferable when used in combination. These surfactants may be added by dissolved in water or alcohol.

The hydrophilic colloidal layer in the present invention means the layer using gelatin as a main binder, and the gelatin is the same those used for stabilization of the latex of the present invention. The hydrophilic colloidal layer includes, for example, a silver halide emulsion layer, a protect layer, an intermediate layer, a backing layer and a backing protect layer. Usually a protect layer and the backing protect layer are provided as outermost layers.

A total amount of gelatin in the hydrophilic colloidal layer coated on the support, including that in the polymer latex stabilized by the gelatin, is not more than 4 g/m$^2$ per each side, and preferably not more than 2.7 g/m$^2$.

Conventional additives may be used for the emulsion related to the present invention. The manufacturing method and the sensitization method of silver halide grains are not especially limited, and the reference is made to Japanese Patent L.O.P. No. 63-230035 and Japanese Patent Application No. 1-266640.

It is preferable to add at least one kind of known contrast intensifying agent such as tetrazolium compound or hydrazine derivative.

In the present invention, the backing side and/or the emulsion layer side of the support may have one or more antistatic layers to prevent electrification, which is another physical property required for the light-sensitive material.

The surface resistivity on the side where the antistatic layer is provided is not more than $1.0\times10^{11}\Omega$, and preferably not more than $8\times10^{11}\Omega$, under the conditions of 25° C. and 50%.

The above-mentioned antistatic layer is preferably a layer containing water-soluble conductive polymer, hydrophobic polymer particles and reactant of a hardener, or a layer containing metal oxide.

The above-mentioned water-soluble conductive polymer has at least one conductive group chosen from a sulfonyl group, a sulfonic acid ester group, a quaternary ammonium salt, a tertiary ammonium salt, a carboxyl group and a polyethylene oxide group. Among them, a sulfonyl group, a sulfonic acid ester group and a quaternary ammonium salt group are preferable. The conductive group requires not less than 5% by weight per molecule of water-soluble conductive polymer. The water-soluble conductive polymer contains a carboxyl group, a hydroxy group, an amino group, an epoxy group, an aziridine group, an active methylene group, a sulfinic acid group, an aldehyde group and a vinylsulfon group. Among them, a carboxyl group, a hydroxy group, an amino group, an epoxy group, an aziridine group and an aldehyde group are preferably contained. These groups are necessarily contained in an amount not less than 5% by weight per molecule of the polymer. The average molecular weight of a water-soluble conductive polymer is 3000 to 100000, and preferably 3500 to 50000.

Moreover, the above-mentioned metal oxide preferably includes tin oxide, indium oxide, antimony oxide, zinc oxide, vanadium oxide and metal oxides doped with metallic silver, metallic phosphor or metallic indium. The average particle size of these metal oxides is preferably from 1 $\mu$ to 0.01 $\mu$.

When the lower layer is an emulsion layer, the matting agent enters in the emulsion layer by pressure since the layer is still soft during the preparation process, and the matting agent destroys the layer partially causing a coating defect, or a winding tension defect.

Known matting agent may be used in the present invention, including inorganic particles such as silica, glass powder, alkaline earth metal or carbonic acid salts; and organic particles such as starch, starch derivative, polyvinyl alcohol, polystyrene or polymethylmetaacrylate, polyacrylonitrile, polycarbonate.

These matting agents can be used alone or in combination. Though the regular shape of the matting agent is preferably spherical, other shapes such as tabular or cubic are also applicable. The size of a matting agent is represented by a diameter of sphere whose volume is equal to that of the matting agent. having an equal volume to that of the matting agent. In the present invention, the particle size of the matting agent means the diameter of a sphere having the same volume as a non-spherical shape.

A preferable embodiment of the present invention is that at least one kind of 4 to 80 mg/m$^2$ of a regular and/or irregular shaped matting agent with the particle size of not less than 4 $\mu$m is comprised in the outermost layer on the emulsion side. More preferably, at least one kind of 4 to 80 mg/m$^2$ of a regular and/or irregular shaped matting agent with the particle size of less than 4 $\mu$m is comprised in combination.

It is preferable that at least a part of the matting agent is included in the outermost layer, and other part of the matting agent can be in the lower layers.

It is preferable that a part of the matting agent is exposed on the surface to accomplish the basic function of the agent. The matting agent exposed on the surface may be either a part of added matting agent or all of it. The matting agent may be dispersed in the coating solution before coating, or may be atomized after coating before the end of drying. When a plurality of different matting agents are added, both methods may be used together. A manufacturing technique to add these matting agents in the light-sensitive material effectively is described in Japanese Patent Application No. 1-228762.

The subbing layer used in the present invention includes a subbing layer processed by organic solvent, which contains polyhydroxybenzenes as described in Japanese Patent L.O.P. No. 49-3972, a subbing layer processed by water-based latex as described in Japanese Patent L.O.P. Nos. 49-11118, 52-104913, 59-19941, 59-19940, 59-18945, 51-112326, 51-117617, 51-58469, 51-114120, 51-121323, 51-123139, 51-114121, 52-139320, 52-65422, 52-109923, 52-119919, 55-65949, 57-128332 and 59-19941, and a subbing layer processed by vinylidene chloride, described in U.S. Pat. Nos. 2698235, 2779684, 425421 and 645731.

Usually, the surface of the subbing layer can be treated chemically or physically by the methods of chemical treatment, mechanical treatment, corona discharge treatment, flame treatment, UV ray treatment, high frequency treatment, glow discharge treatment, active plasma treatment, laser treatment, mixed acid treatment and surface activation treatment such as ozone oxidation. The subbing layer is distinguished from the coating layer of the present invention and there is no limitation to the coating time and conditions.

However, the embodiment of the present invention is effective when it is coated on the polyester support having the vinylidene chloride type subbing layer.

In the present invention, dye dispersed in a solid state as well as normal water-soluble dye is comprised in any hydrophilic colloidal layer. The layer may be an outermost layer on the emulsion side, or layers under an emulsion layer and/or on the backing side to prevent halation. The some of the amount may be added in the emulsion layer for the adjustment of irradiation. Of course, a plurality of solid dispersed dyes may be comprised in two or more layers.

The added amount of the solid dispersed dye is preferably from 5 mg/m$^2$ to 1 g/m$^2$ per kind and more preferably from 10 mg/m$^2$ to 800 mg/m$^2$.

The fine grain of the solid dispersant can be obtained by powdering the dye with a dispersion machine such as a ballmill or sandmill, and dispersing with water, a hydrophilic colloid such as gelatin, and a surface-active agent such as sodium dodecylbenzene sulfonate, fluorinated sodium octylbenzene sulfonate, saponin or nonylphenoxypolyethyleneglycol.

The formula of the dye used in the present invention preferably includes, for instance, Formulae I to V described in U.S. Pat. No. 4,857,446.

The present invention can be applied to various light-sensitive materials such as those for printing, X-rays, general negative, general reversal, general positive and direct positive. Especially, the effect is enhanced when it is applied to light-sensitive material for printing which requires extremely high dimensional stability.

The development temperature of the silver halide photographic light-sensitive material related to the present invention is preferably not more than 50° C., and more preferably between 25° C. and 40° C. Photographic processing time is generally within two minutes, and preferably 5 to 60 seconds.

EXAMPLE 1

An example of the present invention is described in detail.

On the 100 μ polyethyleneterephthalate base subbed as described in Japanese Patent L.O.P. No. 59-19941 and subjected to corona discharge with 10W/($m^2$·min), each coating solution prepared as described above was coated with a roll fit coating pan and an air knife with the following composition so that the coated amount became 10 cc/$m^2$. Then, it was dried at first at a temperature of 90° C. and an overall heat transfer coefficient of 25 Kcal ($m^2$·hour·° C.) for 30 seconds by parallel flowing, and next at a temperature of 140° C. for 90 seconds. The thickness of the layer after drying was 1 μ and the surface resistivity was $1\times10^8\Omega$ at 23° C. and 55%.

Water-soluble conductive polymer 70 g/l

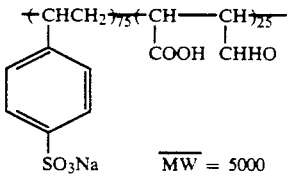

$\overline{MW}$ = 5000

Hydrophobic polymer 40 g/l

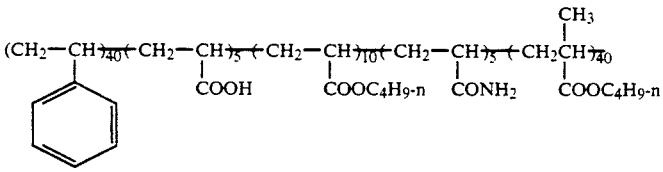

Ammonium sulfate 0.5 g/l
Polyethyleneoxide compound (average molecular weight 600) 6 g/l
Hardener 12 g/l
Mixture of

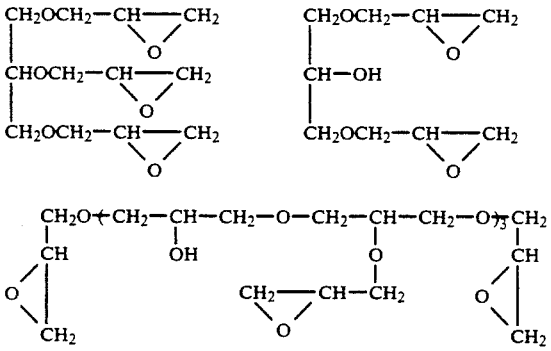

The coating solution for the emulsion layer and that of the emulsion protective layer as prepared mentioned above were coated simultaneously on the support in this order, starting from the support on the emulsion side, adding the hardener solution by the slide hopper method keeping the temperature at 35° C., and the coated material was passed through a cooling set zone at 5° C. The coating solution for the backing layer and that of the backing protective layer were also coated, adding the hardener by the slide hopper method, and the coated material was passed through a cooling set zone at 5° C. After passing each set zone, the coating solution showed sufficient setting characteristics. Both sides were simultaneously dried in the drying zone by the following drying condition. After both sides of the emulsion layer and backing layer were coated, the material was transported by rollers until winding up and with nothing the rest. The coating speed was 100 m/min.

(Synthesis of latex A for comparison)

Sodium dodecylbenzene sulfonate in an amount of 0.01 Kg and 0.05 Kg of ammonium persulfate were added to 40 liters of water. 3.0 Kg of styrene, 3.0 Kg of methylmethacrylate, 3.2 Kg of ethylacrylate and 0.8 Kg of 2-acrylic amido-2-methylpropane sulfonic acid were added to the above-mentioned solution stirring for an hour at a solution temperature of 60° C. under the nitrogen circumstance. The solution was stirred for another 1.5 hours and the remaining monomer was removed by steam distillation for an hour. After being cooled down to room temperature, pH was adjusted to 6.0 using sodium hydroxide. Water was added to the obtained latex solution to make a quantity of 55 Kg, and a monodispersed latex with an average particle size of 0.11 μm was obtained.

(Latex Lx-8)

Gelatin in an amount of 1.0 Kg, 0.01 Kg of sodium dodecylbenzene sulfonate and 0.05 Kg of ammonium persulfate were added to 60 liters of water. 3.0 Kg of styrene, 3.0 Kg of methylmethacrylate, 3.2 Kg of mixture of ethylacrylate and 0.8 Kg of sodium salt of 2-acrylic amido-2-methylpropane sulfonic acid were added to the above-mentioned solution stirring for an hour at a solution temperature of 60° C. under the nitrogen circumstance. The solution was stirred for another 1.5 hours and the remaining monomer was removed by steam distillation for an hour. After being cooled down to room temperature, pH was adjusted to 6.0 by using ammonia. Water was added to the obtained latex solution to make a quantity of 75 Kg, and the monodispersed latex of an average particle size of 0.11 μm was obtained.

(latex Lx-17 )

Sodium dodecylbenzene sulfonate in an amount of 0.01 Kg and 0.05 Kg of ammonium persulfate were added to 40 liters of water. 9.3 Kg of ethylacrylate, 0.4 Kg of the reactant of epichlorohydrin and acrylic acid and 0.3 Kg of the mixture of acrylic acid were added to the above-mentioned solution stirring for an hour at a solution temperature of 80° C. under the nitrogen circumstance, and stirred for another 1.5 hours. Then, 1.0 Kg of gelatin and 0.005 Kg of ammonium persulfate were added and the solution was stirred for 1.5 hours. After reaction, the remaining monomer was removed by steam distillation for an hour. It was cooled down to room temperature, and pH was adjusted to 6.0 by using ammonia. Water was added to the obtained latex solution to make a quantity of 55 Kg, and the monodispersed latex with an average particle size of 0.12 μm was obtained.

(Preparation of emulsion)

A silver sulfate solution and a solution which was made by adding hexachlororhodium complex to a solution of sodium chloride and potassium bromide to become $8\times10^{-5}$ mol/Agmol were added simultaneously into the gelatin solution, controlling the flowing quantity. After desalinization, a cubic crystal monodispersed chlorobromide emulsion with a grain size of 0.13 containing 1 mol% of the silver bromide was obtained.

After this emulsion was sensitized with sulfur in the usual manner, 6-methyl-4-hydroxy-1, 3, 3a, 7 tetrazaindene as a stabilizing agent and the following additives were added, and emulsion coating solutions E-1 to 14 were prepared. Next, the coating solution for emulsion protective layer P-0, the coating solution for backing layer B-0 and the coating solution for backing protective layer BP-0 were prepared with the following compositions.

(Preparation of the emulsion coating solutions E-1 to E-14)

| | |
|---|---|
| Potassium bromide | 5 mg/m$^2$ |
| Compound (a) | 1 mg/m$^2$ |
| NaOH(0.5N) | adjusted to pH 5.6 |
| Compound (b) | 40 mg/m$^2$ |
| Saponin (20%) | 0.5 cc/m$^2$ |
| Sodium dodecyl benzene sulfonate | 20 mg/m$^2$ |
| 5-methylbenztriazole | 10 mg/m$^2$ |
| Compound (d) | 2 mg/m$^2$ |
| Compound (e) | 10 mg/m$^2$ |
| Compound (f) | 6 mg/m$^2$ |
| Latex LX | amount shown in Table 1 |
| Styrene-maleic acid copolymer (thickener) | 90 mg/m$^2$ |

(a)

-continued

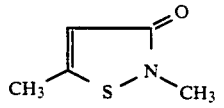

(b)

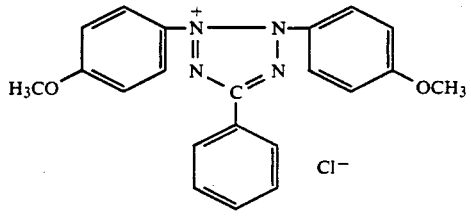

(d)

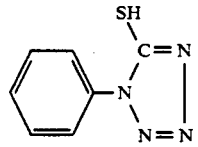

(e)

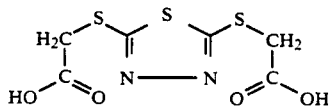

(f)

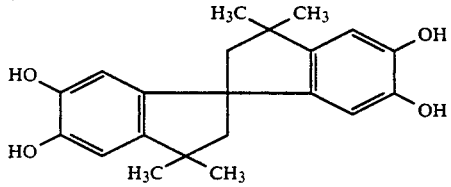

(Coating solution for an emulsion protective layer P-0)

| | |
|---|---|
| Gelatin | amount shown in Table 1 |
| Compound (g) (1%) | 25 cc/m$^2$ |
| Compound (h) | 40 mg/m$^2$ |
| Compound (k) | 100 mg/m$^2$ |
| Spherical monodispersed silica (8μ) | 20 mg/m$^2$ |
| Spherical monodispersed silica (3μ) | 10 mg/m$^2$ |
| Compound (i) | 100 mg/m$^2$ |
| Fluorine containing surfactant of the present invention | amount shown in Table 1 |
| Citric acid | adjusted to pH 5.8 |
| Latex LX of the present invention | amount shown in Table 1 |
| Styrene-maleic acid copolymer (thickener) | 50 mg/m$^2$ |
| Form aldehyde (hardener) | 10 mg/m$^2$ |

(Coating solution for a backing layer B-0)

| | |
|---|---|
| Gelatin | 1.0 g/m$^2$ |
| Compound (j) | 80 mg/m$^2$ |
| Compound (k) | 15 mg/m$^2$ |
| Compound (l) | 150 mg/m$^2$ |
| Calcium chloride | 0.3 mg/m$^2$ |
| Saponin (20%) | 0.6 cc/m$^2$ |
| Citric acid | adjusted to pH 5.5 |
| Latex (m) | 300 mg/m$^2$ |
| 5-methylbenztriazole | 10 mg/m$^2$ |
| 5-nitroindazole | 20 mg/m$^2$ |
| Polyethyleneglycol (molecular weight of 1540) | 10 mg/m$^2$ |
| Styrene-maleic acid copolymer (thickener) | 45 mg/m$^2$ |
| Glyoxal | 4 mg/m$^2$ |
| Compound (n) | 80 mg/m$^2$ |

(Coating solution for a backing protective layer BP-0)

| | |
|---|---|
| Gelatin | amount shown in Table 1 |

-continued

| | |
|---|---|
| Compound (g) (1%) | 2 cc/m$^2$ |
| Compound (j) | 20 mg/m$^2$ |
| Compound (k) | 4 mg/m$^2$ |
| Compound (l) | 50 mg/m$^2$ |
| Spherical polymethylmethacrylate (4μ) | 25 mg/m$^2$ |
| Sodium chloride | 70 mg/m$^2$ |
| Fluorine containing surfactant of the present invention | amount shown in Table 1 |
| Glyoxal | 22 mg/m$^2$ |
| Bisvinylsulfonylmethylether | 5 mg/m$^2$ |

(g)

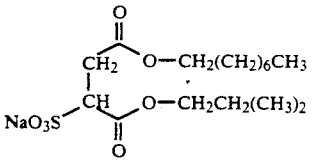

(h)

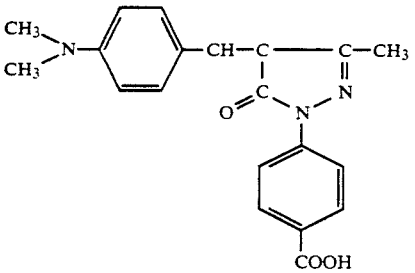

Dispersed Solid Dye (i)

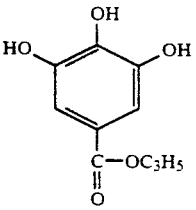

(j)

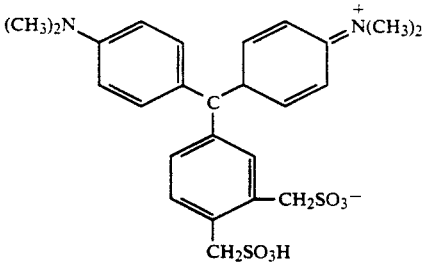

(k)

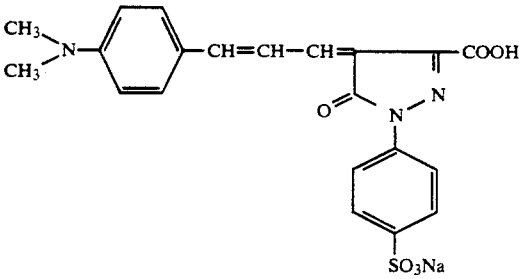

-continued (l)

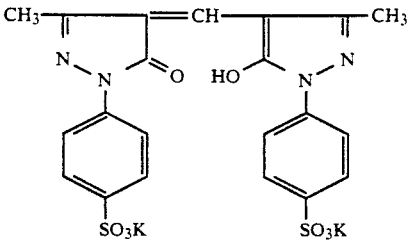

(m)

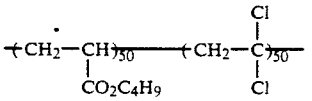

(n)

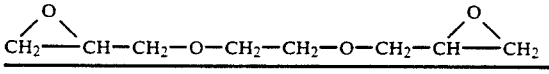

(Drying condition)

the drying air was 30° C. until the ratio of water/gelatin became 800%, and was 35° C. (30%) when the ratio of water/gelatin was reduced from 800% to 200%. The drying was continued until the surface temperature became 34° C. (drying was regarded as finished at this point), and 30 seconds thereafter the drying air with RH 2% was turned to 48° C. for one minute. Drying time was 50 seconds from the beginning of drying to the water/gelatin ratio being 800%, 35 seconds from 800% to 20%, and 5 seconds from 200% to the end of drying.

This light-sensitive material was wound at 23° C. with RH 40%, cut under the same environment, and sealed in a moisture proof bag which was rehumidified for 3 hours under the same environment with cardboard which was rehumidified at 40° C. with RH 10% for 8 hours, and then at 23° C. with RH 40% for 2 hours.

The amount of coated silver in the light-sensitive material made as above was 3.5 g/m$^2$.

The dimensional stability, stickiness and sensitivity variation by aging of the samples Nos.1 to 14 made as above were evaluated as follows.

(Dimensional stability)

The obtained samples were cut to the size of 30 cm ×60 cm. Two fine lines 56 cm apart were exposed with daylight room printer P-627FM (made by the Dainippon Screen Mfg. Co.,Ltd.), and subjected to photographic processing.

This original, an unexposed sample (the same size as the original), the printer, and the processor were rehumidified for two hours at 23° C. with 20%. Then, the unexposed sample was stuck to the original (side to side), exposed, and processed with the processor. After the processed sample was rehumidified for two hours, it was put on the original and the slippage of the interval of fine lines was measured with a measuring loupe. Six samples were used to calculate their average. · · · The average is referred to (a) value The same experiment was done under the conditions of RH 60% at 23° C., and the dimensional difference before and after processing was measured. This value was compared to that of the sample obtained under RH 20% and the difference, which shows the dependence on environmental humidity, was measured. · · · This is referred to (b) value When the (a) value exceeded ±20 μ, dimensional slippage was recognized, and when the (b) value exceeded 20 μ, the variation of the dimensional difference before and after processing was observed, and in this case it was a level requiring a change of some working conditions. (Test for stickiness)

The obtained sample was cut to the size of 3.5 cm × 13.5 cm and rehumidified at 23° C. with RH 80% for one day. The films were stuck together, enclosed in a dampproof bag with a load of 800 g/cm$^2$ and preserved for one day at 40° C. Then the samples were peeled off, and the stuck area (%) was evaluated according to the following standard. Rank A: 0 to 40, B: 41 to 60, C: 61 to 80, and D: 81 to 100

(Test for sensitivity variation in aging)

Two moisture proof bags of obtained samples were prepared. One bag was preserved for three days with RH 50% at 23° C., and the other was preserved for three days at 55° C. Both samples were exposed with a step wedge and processed using the developer and fixer shown below. Sensitivity is represented by an exposure giving 1.0 value of black density and was a relative sensitivity when comparative sample 1 was 100.

| (Standard processing condition) | | |
|---|---|---|
| Development | 28° C. | 30 seconds |
| Fixation | 28° C. | 20 seconds |
| Washing | normal temperature | 15 seconds |
| Drying | 40° C. | 35 seconds |

| Developer composition | |
|---|---|
| (Composition A) | |
| Pure water (ion exchanged water) | 150 ml |
| Disodium ethylenediaminetetraacetate salt | 2 g |
| Diethylene glycol | 50 g |
| Potassium sulfite (55% W/V aqueous solution) | 100 ml |
| Potassium carbonate | 50 g |
| Hydroquinone | 15 g |
| 5-methylbenztriazole | 200 mg |
| 1-phenyl-5-mercaptotetrazole | 30 mg |
| Potassium hydroxide | amount to adjust pH of working solution to 10.9 |
| Potassium bromide | 4.5 g |
| (Composition B) | |

-continued

| | |
|---|---|
| Pure water (ion exchanged water) | 3 ml |
| Diethylene glycol | 50 mg |
| Disodium ethylenediaminetetraacetate salt | 25 mg |
| Sulfuric acid (90% aqueous solution) | 0.3 ml |
| 5-nitroindazole | 110 mg |
| 1-phenyl-3-pyrazolidone | 500 mg |

Above-mentioned compositions A and B were melted in 500 ml of water to make a quantity of one liter.

| Fixer composition | |
|---|---|
| (composition A) | |
| Ammonium thiosulfate (100% conversion) | 168.2 ml |
| Pure water | 5.0 g |
| Sodium sulfite | 5.63 g |
| Sodium acetate trihydrate | 27.8 g |
| Boric acid | 9.78 g |
| Sodium citrate dihydrate | 2 g |
| Acetic acid (90% W/W aqueous solution) | 6.4 g |
| (composition B) | |
| Pure water (ion exchanged water) | 2.82 g |
| Sulfuric acid (50% W/V aqueous solution) | 6.6 g |
| Aluminium sulfate ($Al_2O_3$ conversion content is 8.1% W/V aqueous solution) | 26.3 g |

Above-mentioned compositions A and B were melted in 500 ml water to make a quantity of one liter. The pH of this fixer was about 4.38.

The results are shown in Table 1 and Table 2.

TABLE 1

| | Emulsion layer | | | Emulsion protective layer | | | | | Backing protective layer | | |
|---|---|---|---|---|---|---|---|---|---|---|---|
| Sample No. | LX | Amount*1 g/m$^2$ | Gelatin*2 coated amount g/m$^2$ | LX | Amount*1 g/m$^2$ | Gelatin*2 coated amount g/m$^2$ | Fluorine type surfac-tant | Amount mg/m$^2$ | Fluorine type surfac-tant | Amount mg/m$^2$ | Gelatin*3 coated amount g/m$^2$ |
| 1 | — | — | 2.3 | — | — | 1.0 | — | — | — | — | 3.5 |
| 2 | A | 0.5 | 2.3 | A | 0.5 | 1.0 | — | — | — | — | 3.5 |
| 3 | LX-17 | 0.5 | 2.3 | LX-17 | 0.5 | 1.0 | a | 1.5 | a | 1.5 | 3.5 |
| 4 | LX-17 | 0.5 | 2.3 | LX-17 | 0.5 | 1.0 | FA-7 | 1.5 | — | — | 3.5 |
| 5 | LX-17 | 0.5 | 2.3 | LX-17 | 0.5 | 1.0 | FA-7 | 1.5 | FA-7 | 1.5 | 3.5 |
| 6 | LX-17 | 0.5 | 1.6 | LX-17 | 0.5 | 0.7 | FA-7 | 1.5 | — | — | 2.6 |
| 7 | LX-8 | 0.5 | 1.6 | LX-8 | 0.5 | 0.7 | FA-7 | 1.5 | — | — | 2.6 |
| 8 | LX-8 | 0.5 | 1.6 | LX-8 | 0.5 | 0.7 | FA-7 | 1.5 | FA-7 | 1.5 | 2.6 |
| 9 | LX-8 | 0.5 | 1.6 | LX-8 | 0.5 | 0.7 | FA-4 | 2.0 | — | — | 2.6 |
| 10 | LX-8 | 0.5 | 1.6 | LX-8 | 0.5 | 0.7 | FA-5 | 2.0 | — | — | 2.6 |
| 11 | LX-8 | 0.5 | 1.6 | LX-8 | 0.5 | 0.7 | FA-4 | 2.0 | — | — | 2.6 |
| | | | | | | | FA-5 | 2.0 | | | |
| 12 | LX-8 | 0.8 | 1.6 | LX-8 | 0.6 | 0.7 | FK-4 | 2.0 | — | — | 2.6 |
| | | | | | | | FK-5 | 2.0 | | | |
| 13 | LX-8 | 0.8 | 1.6 | LX-8 | 0.6 | 0.7 | FA-4 | 2.0 | FA-4 | 2.0 | 2.6 |
| | | | | | | | FK-5 | 2.0 | FK-5 | 2.0 | |
| 14 | LX-8 | 0.8 | 1.2 | LX-8 | 0.6 | 0.7 | FA-4 | 2.0 | FA-4 | 2.0 | 2.0 |
| | | | | | | | FK-5 | 2.0 | FK-5 | 2.0 | |

TABLE 2

| Sample No. | Dimensional difference (a) | Dimensional difference (b) | Stickiness | Sensitivity variation 23° C. 3 days | Sensitivity variation 55° C. 3 days |
|---|---|---|---|---|---|
| 1 | +60 μm | +70 μm | A | 100 | 90 |
| 2 | +45 | +50 | D | 100 | 50 |
| 3 | +35 | +37 | C | 100 | 50 |
| 4 | +35 | +37 | B | 100 | 85 |
| 5 | +35 | +37 | A | 100 | 85 |
| 6 | +30 | +32 | B | 100 | 85 |
| 7 | +27 | +27 | B | 100 | 85 |
| 8 | +27 | +27 | A | 100 | 95 |
| 9 | +27 | +27 | B | 100 | 85 |
| 10 | +27 | +27 | B | 100 | 85 |
| 11 | +27 | +27 | A | 100 | 95 |
| 12 | +25 | +20 | B | 100 | 95 |

TABLE 2-continued

| Sample No. | Dimensional difference (a) | Dimensional difference (b) | Stickiness | Sensitivity variation 23° C. 3 days | Sensitivity variation 55° C. 3 days |
|---|---|---|---|---|---|
| 13 | +25 | +20 | A | 100 | 95 |
| 14 | +18 | +15 | A | 100 | 90 |

Comparative compound a.

$$\begin{array}{l} CH_2-COOCH_2-(CF_2)_6-H \\ | \\ NaO_3S-CH-COOCH_2-(CF_2)_6-H \end{array}$$

*1 Amount as solid element of latex
*2 Amount including those brought from latex
*3 Amount of backing layer and backing protective layer As is clear from the results of Table 1 and Table 2, the samples of the present invention have excellent dimensional stability, stickiness, and sensitivity stability during aging.

Example 2

The same effect was obtained when the experiment was done in the same manner as Example 1 except that the following compound was used instead of compound (b) in the emulsion coating solution of Example 1.

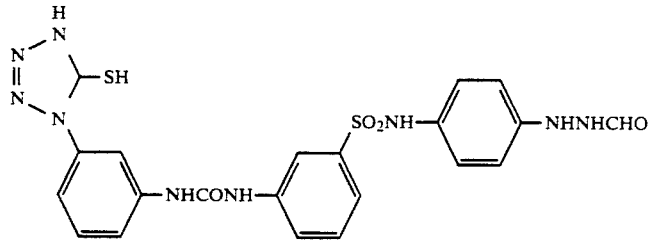

The present invention can provide a silver halide photographic light-sensitive material with excellent dimensional stability, free from stickiness and deterioration of sensitivity over time.

We claim.

1. A silver halide photographic light-sensitive material comprising a support having provided on a first side thereof, in order, at least one light-sensitive silver halide emulsion layer, and a protective layer, and, on a second side of said support, in order, a backing layer, and a backing protective layer, wherein at least one of the light-sensitive silver halide emulsion layer, the protective layer, the backing layer, and the backing protective layer contains polymer latex stabilized by gelatin, comprising latex that is reacted with gelatin after polymerization reaction, or latex polymerized in the presence of gelatin, at least one of said protective layer and backing protective layer comprising a surfactant selected from the group consisting of anionic fluorine-containing surfactants represented by Formula FA and cationic fluorine-containing surfactants represented by Formula FK;

Formula FA $$Rf-(A)_n-Y$$

wherein, Rf represents a fluorine substituted alkyl group or an aryl group having 3 to 30 carbon atoms, A represents a divalent group having 1 to 12 carbon atoms containing at least one bond of $$-O-,\ -COO-,\ -\underset{\underset{R_1}{|}}{CON}-\ \text{or}\ -\underset{\underset{R_1}{|}}{SO_2N}-,$$

wherein $R_1$ represents an alkyl group having 1 to 5 carbon atoms, n is 1 to 2, Y represents $$-COOM,\ -SO_3M-,\ -OSO_3M\ \text{or}\ -\underset{\underset{O}{\|}}{P}(OM)_2,$$

wherein M represents a hydrogen atom or cations of alkali metal, alkaline earth metal or quaternary ammonium salts;

Formula FK $$(Df)-(W)_n$$

wherein, Df represents the n-valent group which contains at least three fluorine atoms and at least three carbon atoms, W represents $$-N^+\begin{matrix} R_1 \\ R_2 \\ R_3 \end{matrix}\ X^-\ \text{or}\ -{}^+N\ \ Z\ X^-$$

wherein R1, R2 and R3 each represents an alkyl group having 1 to 4 carbon atoms, or an alkyl group substituted by a univalent X represents a halogen atom or the $R-SO_2-O-$ group (R is an alkyl group or an aryl group having 1 to 10 carbon atoms), Z represents an atomic group necessary to constitute a 5 or 6-membered cycle, and n is 1 or 2.

2. The silver halide photographic light-sensitive material of claim 1, wherein the combined amount of gelatin in layers coated on each side of the support is not more than 2.7 g/m$^2$ per each side.

3. The silver halide photographic light-sensitive material of claim 1, wherein an average particle size of the polymer latex stabilized by the gelatin is 0.005 to 1 μm.

4. The silver halide photographic light-sensitive material of claim 1, wherein an average particle size of the polymer latex stabilized by the gelatin is 0.02 to 0.5 μm.

5. The silver halide photographic light-sensitive material of claim 1, wherein the polymer latex stabilized by the gelatin is synthesized a gelatin and a polymer in a ratio of 1:100 to 2:1.

6. The silver halide photographic light-sensitive material of claim 1, wherein the polymer latex stabilized by the gelatin is synthesized a gelatin and a polymer in a ratio of 1:50 to 1:2.

7. A sliver halide photographic light-sensitive material comprising a support having provided, in order, on a first side thereof, at least one light-sensitive silver halide emulsion layer, and a protective layer, and on a second side of said support, in order, a backing layer, and a backing protective layer, wherein said at least one light-sensitive silver halide emulsion layer and said protective layer contains polymer latex stabilized by gelatin comprising latex that is reacted with gelatin after polymerization reaction, or latex polymerized in the presence of gelatin, and at least one of said protective layer and said backing protective layer comprises at least one surfactant selected from the group consisting of anionic fluorine-containing surfactants represented by Formula FA, and cationic fluorine-containing surfactants represented by Formula FK;

Formula FA $$Rf\text{—}(A)_n\text{—}Y$$

wherein, Rf represents a fluorine substituted alkyl group or an aryl group having 3 to 30 carbon atoms, A represents a divalent group having 1 to 12 carbon atoms containing at least one bond of $$-O-,\ -COO-,\ -\underset{\underset{R_1}{|}}{CON}-\ \text{or}\ -SO_2\underset{\underset{R_1}{|}}{N}-,$$

wherein $R_1$ represents an alkyl group having 1 to 5 carbon atoms, n is 1 or 2, Y represents $$-COOM.\ -SO_3M-,\ -OSO_3M\ \text{or}\ -\underset{\underset{O}{\|}}{P}(OM)_2,$$

wherein M represents a hydrogen atom or cations of alkali metal, alkaline earth metal or quaternary ammonium salts;

Formula FK $$(Df)\text{—}(W)_n$$

wherein, Df represents the n-valent group which contains at least three fluorine atoms and at least three carbon atoms, W represents

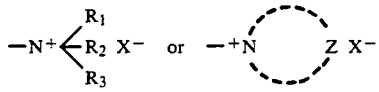

wherein R1, R2 and R3 each represent an alkyl group having 1 to 4 carbon atoms, or an alkyl group substituted by a univalent group, X represents a halogen atom, or the $R—SO_2—O^-$group (R is an alkyl group or an aryl group having 1 to 10 carbon atoms), Z represents an atomic group necessary to constitute a 5 or 6-membered cycle, and n is 1 or 2.

* * * * *